US012497867B2

(12) United States Patent
Gunnarsson

(10) Patent No.: US 12,497,867 B2
(45) Date of Patent: Dec. 16, 2025

(54) SAND SCREENS AND RELATED PRODUCTS AND METHODS

(71) Applicant: ISEALATE AS, Stavanger (NO)

(72) Inventor: Bengt Gunnarsson, Hundvåg (NO)

(73) Assignee: ISEALATE AS, Stavanger (NO)

( * ) Notice: Subject to any disclaimer, the term of this patent is extended or adjusted under 35 U.S.C. 154(b) by 0 days.

(21) Appl. No.: 18/695,659

(22) PCT Filed: Sep. 9, 2022

(86) PCT No.: PCT/NO2022/050208
§ 371 (c)(1),
(2) Date: Mar. 26, 2024

(87) PCT Pub. No.: WO2023/038531
PCT Pub. Date: Mar. 16, 2023

(65) Prior Publication Data

US 2024/0392660 A1 Nov. 28, 2024

(30) Foreign Application Priority Data

Sep. 9, 2021 (NO) ..... 20211086

(51) Int. Cl.
*E21B 43/10* (2006.01)

(52) U.S. Cl.
CPC ..... *E21B 43/108* (2013.01); *E21B 43/105* (2013.01)

(58) Field of Classification Search
CPC ..... E21B 43/108; E21B 43/105; E21B 43/08; E21B 43/103
See application file for complete search history.

(56) References Cited

U.S. PATENT DOCUMENTS

| | | | | |
|---|---|---|---|---|
| 3,439,740 | A * | 4/1969 | Conover | E21B 49/087 166/290 |
| 5,186,215 | A | 2/1993 | Gilleland | |
| 2001/0039711 | A1 | 11/2001 | Donnelly et al. | |
| 2004/0104026 | A1 | 6/2004 | Johnson et al. | |
| 2005/0155773 | A1* | 7/2005 | Wetzel | E21B 43/108 166/227 |
| 2010/0038076 | A1 | 2/2010 | Spray et al. | |
| 2019/0049054 | A1* | 2/2019 | Gunnarsson | F16L 55/1656 |

FOREIGN PATENT DOCUMENTS

| | | | |
|---|---|---|---|
| WO | 03100211 | A1 | 12/2003 |
| WO | 2015128454 | A1 | 9/2015 |

OTHER PUBLICATIONS

First Office Action for Norwegian Application No. 20211086 dated Mar. 10, 2022, 5 pages.

(Continued)

*Primary Examiner* — Tara Schimpf
*Assistant Examiner* — Daniel T Craig
(74) *Attorney, Agent, or Firm* — Nixon & Vanderhye P.C.

(57) ABSTRACT

An expandable sand screen device is described comprising in various examples a rolled-up piece of screen material which is configured to be at least partially unrollable to expand diametrically when located in a wellbore. A piece of screen material may be rolled up to form an expandable roll. In some examples, the expandable sand screen device is run into the wellbore on a running tool and allowed to partially unroll once released from the running tool.

28 Claims, 5 Drawing Sheets

(56) References Cited

OTHER PUBLICATIONS

Second Office Action for Norwegian Application No. 20211086 dated Feb. 13, 2023, 3 pages.
Search Report for for Norwegian Application No. 20211086 dated Mar. 10, 2022, 2 pages.
International Search Report for PCT/NO2022/050208 dated Jan. 10, 2023, 4 pages.
Written Opinion of the ISA for PCT/NO2022/050208 dated Jan. 10, 2023, 7 pages.
Communication Pursuant to Article 94(3) EPC mailed Oct. 14, 2025 in European Application No. 22 787 014.4, 13 pages.

* cited by examiner

SAND SCREENS AND RELATED PRODUCTS AND METHODS

This application is the U.S. national phase of International Application No. PCT/NO2022/050208 filed Sep. 9, 2022 which designated the U.S. and claims priority to NO patent application No. 20211086 filed Sep. 9, 2021, the entire contents of each of which are hereby incorporated by reference.

The present invention relates to the downhole completion of wellbores, and in particular to the setting of sand screens.

In the oil and gas exploration and production industry, a sand screen is typically set as part of the downhole completion of a wellbore. This is generally a preventive measure against influx of sand into the wellbore during extraction of fluid from the reservoir. Various expandable sand screens are known. One example is the Weatherford ESS™ expandable sand screen. When setting the ESS™ expandable sand screen, an expansion tool is run axially through the sand screen, the expansion tool having an outer diameter causing the sand screen to expand outwardly towards the inner wall of the wellbore as the tool advances through sand screen.

Amongst the aims and objects of the invention is to obviate or at least mitigate one or more drawbacks of the prior art.

According to a first aspect of the invention, there is provided an expandable sand screen device comprising a rolled-up piece of screen material which is configured to be at least partially unrollable to expand diametrically when located in a wellbore.

Typically, the screen material is resilient for urging the piece of screen material to at least partially unroll or self-unroll.

Typically, the expandable sand screen device is expandable in diameter between a first configuration in which the piece of material is rolled up, and a second, expanded configuration, in which the piece of material is at least partially unrolled. The piece of screen material can be self-unrollable during at least part of the expansion from the first to the second configuration.

Typically, the screen material has apertures extending through the material for restricting passage of sand and permitting passage of fluid from the subsurface penetrated by the wellbore, in operational use.

Typically, the screen material has a thickness in the range of 0.1 to 0.5 mm. The screen material may be steel or spring steel or any other suitable material.

Typically, the expandable sand screen device further comprises adhesive applied to the piece of screen material for adhesively fastening or bonding overlapping sections or layers of the piece of material to one another.

The sand screen device may include adhesive between at least one pair of adjacent overlapping layer sections of the piece of screen material. Using the adhesive, the overlapping layer sections may be adhesively secured together. The adhesive may be e.g. a glue or an epoxy or any other type of adhesive suitable for the purpose.

The adhesive may comprise a compound that has attributes making it particularly suitable, such as being able to create a strong bond between the sand screen and the wall of the wellbore, being able to set quickly, not setting too quickly and/or not setting unless exposed to a certain temperature, such as an ambient temperature at a certain depth in a wellbore and/or other attributes. The adhesive may be configured to be activated, e.g. to soften and set, by a temperature in the wellbore exceeding an activation temperature of the adhesive. Accordingly, activation of the adhesive may advantageously be delayed until the piece of material is brought into position at the part of the wall of the conduit to be lined.

One or more qualities of the adhesive may be improved by increasing the temperature of the adhesive up to a certain temperature. For example, a bonding strength of the adhesive may be increased by heating the adhesive and/or a set time of the adhesive may be increased by a heating up of the adhesive. The heating may be produce an increase in temperature of 20 degrees Celsius, 40 degrees Celsius, 60 degrees Celsius, 80 degrees Celsius, 100 degrees Celsius or more than 100 degrees Celsius, from e.g. a typical bore-hole temperature. In some cases, the prevailing or pre-existing downhole temperature may be a temperature which is optimal or close to optimal for the adhesive. The set time may be the time it takes for the adhesive to set/to cure/to harden. The bonding strength may be the strength of a bond created by the adhesive to bind an inner section of the piece of material to an outer section of the piece of material when the device is expanded. The heater may be configured for heating the compound to a temperature that increases one or more qualities of the adhesive. The heater may be configured to provide said heating up of the adhesive.

A plurality of openings or apertures may be arranged as a mesh in a surface of the sand screen. The sand screen may be designed with openings or apertures arranged in a pattern that will allow sufficient flow regardless of the diameter of the tubing in which the sand screen is set.

In certain embodiments, the screen material, or apertures or openings thereof, can comprise a first set of apertures having a longitudinal extent a first direction and a second set of apertures having a longitudinal extent in a second direction which is transverse to the first direction, so that in at least the expanded configuration, sections of the screen material overlap and at least some of the apertures of the first set of apertures cross at least some of the apertures of the second set of apertures to thereby provide screen holes at intersections where apertures of the first and second sets cross, the screen holes penetrating through the overlapping sections of the sand screen device between an outside and an inside of the sand screen device.

According to a second aspect of the invention, there is provided a piece of sand screen sheet material which is configured to be rolled up for providing an expandable sand screen device in accordance with the first aspect of the invention.

Typically, the piece of sand screen sheet material has a thickness in the range of 0.1 to 0.5 mm. Typically, the screen sheet material comprises steel or spring steel sheet material.

Typically, the piece of sand screen sheet material is resilient and exerts a restoring force in response to being rolled up for facilitating at least partial unrolling of the material.

Typically, the piece of sand screen sheet material has apertures extending through the sheet material.

According to a third aspect of the invention, there is provided a sand screen setting assembly comprising: an expandable sand screen device in accordance with the first aspect of the invention; and a running tool carrying the expandable sand screen device.

Typically, the running tool comprises at least one forcing device for applying outward force to the screen material.

Typically, the sand screen device is provided with adhesive for adhesively securing overlapping sections of the piece of material to one another when expanded, and wherein typically also the running tool has a heater for supplying heat to the adhesive in use for facilitating activation, curing, or adhesion of the adhesive, and wherein typically also the forcing device is configured to apply outward force to the screen material in an expanded configuration of the sand screen device and in the process of activation, curing or adhesion of the adhesive, in use.

According to a fourth aspect of the invention, there is provided a running tool for carrying and deploying an expandable sand screen in accordance with the first aspect of the invention in a wellbore, the running tool comprising: a tool body; and a structure for supporting the expandable sand screen on the tool body in the rolled-up configuration in such a way that the piece of screen material extends circumferentially around the main body.

Typically, the forcing device is or comprises an inflatable structure.

The inflatable structure can typically be coupled to fluid communication means and can be inflatable by supplied hydraulic fluid through the fluid communication means.

In various embodiments, the sand screen device typically is expandable in diameter between a first configuration in which the piece of material is rolled up, and a second, expanded configuration, in which the piece of material is at least partially unrolled, wherein the piece of screen material is configured to at least partially unroll during expansion from the first to the second configuration, and wherein the forcing device is arranged to facilitate in either or both the first and second configurations to impart outward force to the screen material.

Typically, the running tool further comprises a bypass passage extending along the tool body on an inside of the rolled up or partially unrolled sand screen device, the passageway arranged for communicating wellbore fluid between region downhole of the sand screen device and a region uphole of the sand screen device.

Typically, the running tool further comprises at least one retainer for retaining the piece of material in the rolled-up configuration. For example, the retainer may be a severable band.

Typically, the structure for supporting the expandable sand screen on the tool body in the rolled-up configuration comprises an inflatable structure, or inflation device, or the forcing device being or comprising an inflatable structure, which is inflatable to impart a component of force outwardly upon the expandable sand screen.

Typically, the structure for supporting the expandable sand screen on the tool body in the rolled-up configuration is inflatable to move a side wall of the structure outwardly.

Typically, the running tool further comprises a bypass passageway for obtaining fluid communication through the tool body between an uphole region and a downhole region of the wellbore.

Typically, the expandable sand screen device comprises a piece of material with adhesive applied to the material and to be disposed in a region between an inner section or layer of the piece of screen material and an adjacent overlapping outer section or layer of the piece of material for adhering the inner section or layer to the outer section or layer. The running tool further may comprise at least one heater element for generating heat to facilitate use or application of the adhesive.

Typically, the running tool further comprises at least one heater for supplying heat to facilitate activation, curing, or adhesion of adhesive for adhesively securing the sand screen device to the wellbore wall or adhesively securing overlapping sections or layers of the screen material together.

Typically, the running tool may further comprise a protective sleeve arranged to be movable from a first position to a second position, wherein in the first position the sleeve is arranged around the sand screen device for protecting the sand screen device and in the second position the sleeve is arranged away from the sand screen device to allow the sand screen device to unroll and/or be expanded.

The wall of the wellbore may be a wall of a wellbore tubing or tubular. The wellbore tubing or tubular may be perforated. The wellbore tubing may be a production tubing.

The running tool may comprise a compartment for containing or holding the sand screen during a run-in into the wellbore.

The sand screen device may be protected from an exterior in the wellbore by a protective device of the running tool, e.g. for protecting the screen from pollution that may e.g. cover one or more of the openings in the sand screen or that may e.g. compromise the quality of the adhesive. The pollution may come from e.g. a wellbore fluid or a particle or a grain in the wellbore.

The protective device may be a sleeve. The sleeve may be axially movable along a longitudinal axis of the running tool. The sleeve may e.g. be movable from a position in which it covers the compartment to a position that allows the sand screen to be released and to unroll from the compartment.

In some embodiments, the running tool may comprise a compartment for the sand screen device, but may not have a sleeve to cover the compartment. The sand screen device may instead be protected by another type of protective device. The protective device may be a protective covering e.g. a fabric or a protective compound that may be removed while, prior to or shortly after release of the sand screen. The protective covering may e.g. be pulled off the sand screen, removed by injection of a chemical, or removed by e.g. application of heat.

The running tool may include a heater for providing heat, e.g. for heating the adhesive and/or for heating a protective compound. In embodiments including a heater, the heater may comprise e.g. a device for providing a heated fluid to the sand screen or to an region in close proximity to the sand screen. The region in close proximity to the sand screen may be a region where the heated fluid may significantly affect the temperature of e.g. the sand screen or of the protective compound or of the adhesive. The heater may comprise e.g. a heater cable, a heating coil and/or a heating mat. The heater may e.g. be arranged on an inside of the tool relative to the sand screen, or in a position on the tool that may allow for the heater to be moved closer to the sand screen after release of the sand screen. The heater or one or more parts of the heater may be movable outwardly, from a position in the tool, to allow for a heated part of the heater to be moved closer to the sand screen after release of the sand screen, to more efficiently heat up the sand screen and/or the compound and/or the adhesive.

The running tool may further comprise a forcing device for forcing the sand screen device against a wall of the wellbore. The forcing device may be a device that holds the sand screen in place against the wall of the wellbore while the adhesive sets to sufficiently bond between the overlapping layer sections of the piece of screen material. The forcing device may be a device such as a jack or a type of bladder. The running tool may have the forcing device in a compartment, on an inside of the sand screen prior to release of the sand screen. The forcing device may be a device that is configured to expand outwardly upon activation, e.g. by increasing its outwardly reach from a centre of the wellbore towards the wall of the wellbore and/or by increasing its outer diameter. The forcing device may e.g. be a device capable of forcing the sand screen against a wall of a tubing having an inner diameter of 4.5 inches or less. In some embodiments, the forcing device may be capable of forcing the sand screen against a wall of a tubing having an inner diameter greater than 4.5 inches. The forcing device in various embodiments is the inflatable structure.

In some embodiments, the forcing device may be a first forcing device and the running tool may additionally have a second forcing device, e.g. at a lower or upper end, or elsewhere, on the running tool. The second forcing tool can have a greater reach than the first forcing device. In such embodiments, the forcing device may be used to release the sand screen and the second forcing device may be used to force the sand screen against a wall of a tubing.

The wall of the wellbore may be e.g. a wall of a conduit, such as a casing or tubing. The casing or tubing may typically have an opening of a certain length, and the sand screen may be of greater length such that when setting the sand screen a part of the sand screen may cover the opening and another part of the sand screen may connect with a part of the wall of the casing or tubing to bond with the part of the wall of the casing or tubing.

The running tool may include an actuator, or more than one actuator, to be used e.g. to initiate release of the sand screen, and/or for e.g. setting one or more packers, and/or to activate the heater or the forcing device.

The running tool may comprise a releasable locking device for keeping the sand screen locked in its rolled-up configuration. The releasable locking device may be a device that is e.g. movable or destructible to release the sand screen.

The running tool may have a plurality of expandable sand screen devices sand screens respectively releasable from the running tool to be set against a wall of the wellbore in a single run-in of the running tool into the wellbore.

The running tool may comprise a plurality of compartments for holding or containing a plurality of sand screens. The running tool may further have a plurality of heaters and/or a plurality of forcing devices.

The running tool may comprise a plurality of forcing devices. In an embodiment, the running tool may e.g. comprise one upper and one lower forcing device, wherein the upper forcing device is for forcing an upper part of the sand screen against an upper portion of the wall of the wellbore, and the lower forcing device is for forcing a lower part of the sand screen against a lower portion of the wall of the wellbore. The wellbore may have an opening between said upper portion of the wellbore and said lower portion of the wellbore, and the sand screen may be set to cover said opening.

According to a fifth aspect of the invention, there is provided a method of setting a sand screen in a wellbore, the method comprising the steps of: (a) running a rolled-up expandable sand screen device into the wellbore; and (b) at least partially unrolling the sand screen device in the wellbore, expanding the sand screen device to emplace the sand screen device on a surrounding wall of the wellbore.

For example, the method can comprise: (a) running a rolled-up expandable sand screen device into the wellbore, the sand screen device comprising a piece of screen material having a thickness in the range of 0.1 to 0.5 mm; and (b) at least partially unrolling the sand screen device in the wellbore, expanding the sand screen device to emplace the sand screen device on a surrounding wall of the wellbore, letting the sand screen device at least partially unroll, the screen material being resilient to urge the sand screen device to unroll; and (c) using at least one forcing device to apply an outward force to the screen material.

Typically, the method includes: running the rolled-up sand screen device into the wellbore on a running tool, the sand screen device being retained in the rolled-up configuration by at least one retainer; and releasing the sand screen from retainment, allowing the released sand screen device to at least partially unroll to expand the sand screen device.

Typically, the method includes using the forcing device to apply the outward force to release the sand screen from retainment.

Typically, the forcing device has an inflatable structure, and the method typically includes inflating the inflatable structure to operate the forcing device. The method may include inflating the inflatable structure with hydraulic fluid.

In the course of using the forcing device, and in the at least partially unrolled configuration of the sand screen device, the method may include directing wellbore fluid through a bypass passageway of the running tool on an inside of the sand screen device, between a region of the wellbore downhole of the sand screen device and a region of the wellbore uphole of the sand screen device.

Typically, the running tool has tool body and a structure for supporting the sand screen device on the tool body in such a way that the sand screen device extends circumferentially around the tool body, the sand screen is supported on a main body, expanding diametrically away from the tool body.

Typically, the method includes at least partially unrolling or letting the sand screen device self-unroll and expand until it meets the surrounding wall.

Typically, the sand screen device comprises a piece of screen material with adhesive which when the sand screen device is emplaced at the wall after at least partial unrolling is disposed between at least one pair of adjacent overlapping layer sections of the piece of screen material. Using the adhesive, the overlapping layer sections may be adhesively secured together. The overlapping sections may be locked fixedly relative to one another by means of the adhesive. The sand screen may therefore better withstand pressure and hold its form under operation, e.g. in the presence of high pressures of fluid and material against an exterior of the device in the wellbore.

Typically, the method includes producing heat in the wellbore to facilitate use of the adhesive for adhesion of the one layer section of the pair to the other.

Typically, the running tool comprises at least one heater device and, the method typically includes: either or both adhesively securing the sand screen device to the wellbore wall, and adhesively securing overlapping sections of the piece of screen material together; and supplying heat from the heater device to facilitate activation, curing, or adhesion of the adhesive. Typically also, the sand screen device can expand in diameter between a first configuration in which the piece of material is rolled up, and a second, expanded configuration, in which the piece of material is at least partially unrolled, wherein the piece of screen material can be resilient to urge the sand screen device to self-unroll during at least part of expansion from the first to the second configuration, and which includes: using the forcing device to impart outward force to the screen material in the second configuration, simultaneously supplying heat from the heater, thereby facilitating the activation, curing, or adhesion of the adhesive.

Typically, the sand screen device expands in diameter between a first configuration in which the piece of material is rolled up, and a second, expanded configuration, in which the piece of material is at least partially unrolled, and the sand screen device comprises overlapping sections of the piece of screen material, and wherein the sand screen has first slots and second slots which are arranged transverse to the second slots, apertures being formed at the intersection of the transverse first and second slots in the second, expanded configuration, the slots penetrating radially through the sand screen device between an outside and an inside of the device for permitting reservoir fluid flow.

Preferably, the sand screen device is the sand screen device according to the first aspect of the invention.

Preferably, the running tool is the running tool according to the fourth aspect of the invention.

The method may include: providing a sand screen in the wellbore, the sand screen being configured to self-expand in the wellbore, running the sand screen to a position for the sand screen to be set in the wellbore, releasing the sand screen when in position, and allowing the sand screen to self-expand after release of the sand screen.

The method may include a step of releasably locking or retaining the sand screen device in or on the running tool by use of a locking device or retainer. The sand screen device may be located in a compartment in the running tool.

The method may further comprise the step of releasing the sand screen from locked configuration or retainment upon running tool. The step of releasing the sand screen may include using an actuator to activate the locking device to release the sand screen. The step of releasing the sand screen device may allow the sand screen device to self-expand into position against the wall of the wellbore.

The method may include the step of pulling back a sleeve, e.g. the protective sleeve, from covering the sand screen prior to release of the sand screen.

The method may further comprise the step of heating up the sand screen device, e.g. by use of the heater or by use of ambient temperature in the wellbore, prior to release of the sand screen and/or while releasing the sand screen and/or after release of the sand screen. The sand screen device typically has an adhesive applied to the sheet. The step of heating up the sand screen may be a step to heat up a compound to remove the compound from the sand screen to allow for the sand screen to unroll and/or to allow for the adhesive to sufficiently connect with an outer overlapping section of the piece of material. The step of heating up the sand screen may be a step to heat up the adhesive to improve one or more qualities of the adhesive, to prepare the adhesive for setting of the sand screen and/or for improving a bond created between overlapping sections of the sand screen device or for shortening the time it takes to create a sufficient bond between the sand screen device and the wall of the wellbore.

The method may further comprise the step of forcing the sand screen against the wall of the wellbore. The step of forcing the sand screen against the wall of the wellbore may be performed by use of the forcing device. The step may involve using one or more forcing devices to force the sand screen against the wall of the wellbore. The step may involve using an upper forcing device for forcing an upper part of the sand screen against an upper portion of the wall of the wellbore and a lower forcing device for forcing a lower part of the sand screen against a lower portion of the wall of the wellbore.

According to a sixth aspect of the invention, there is provided a completed well comprising at least one sand screen device which is emplaced on a wall of a wellbore of the well by performing the method in accordance with the fifth aspect of the invention.

Any of the aspects of the invention may include further features as described in relation to any other aspect of the invention, wherever described herein.

Embodiments of the various aspects of the invention can be advantageous in various ways. For instance, in various embodiments, the expandable sand screen device by being rolled up may have a limited outer diameter when the sand screen is loaded into the running tool, which can help with transporting the sand screen device through narrow sections of a wellbore. The sand screen device in various embodiments may be advantageous as installation equipment may be simplified and less costly, in particular where it can unroll once released under own impetus.

There will now be described, by way of example only, embodiments of the invention, with reference to the accompanying drawings, in which.

Figure 1:
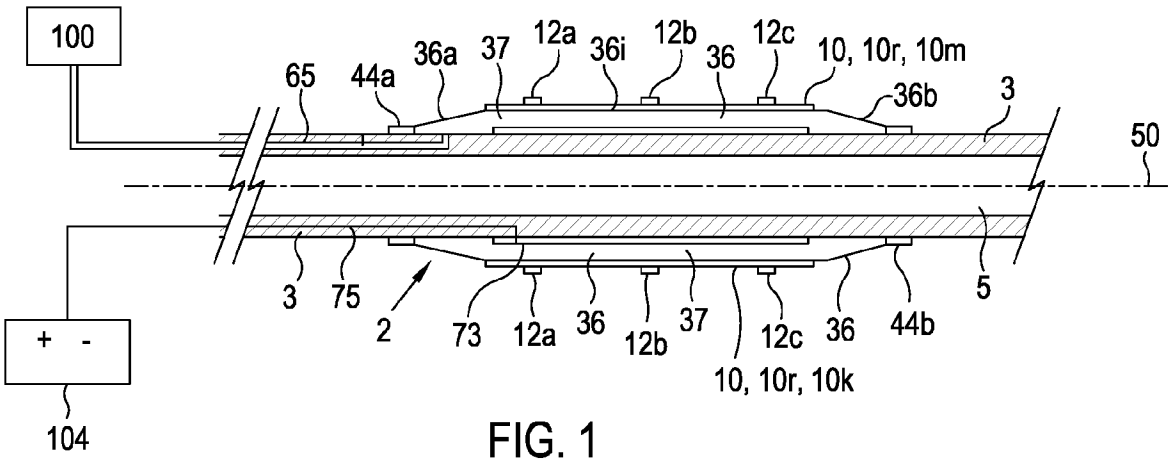
FIG. 1 is a schematic representation of a running tool with a sand screen arranged on the running tool, in a run-in configuration.

With reference first to FIG. 1, a screen setting apparatus 1 is generally depicted at reference numeral 1. The screen setting apparatus 1 includes a running tool 2 and a rolled-up expandable screen device 10.

The running tool 2 has a tool body 3 configured to be coupled to a conveyancing means (not shown).

The expandable sand screen device 10 comprises a piece, for example a leaf or a sheet, of screen material 10*m* that is rolled up about a longitudinal axis 50. The sand screen device 10 is in the form of a roll 10*r* that extends circumferentially around an outer portion of the tool body 3. The sheet material 10*m* is retained in rolled up configuration upon the tool body 3. The screen setting apparatus 1 includes retainers in the form of circumferential bands 12*a*-12*c* which extend around the roll 10*r*. The bands 12*a*-12*c* can prevent the roll 10*r* from coming undone.

Figure 2:
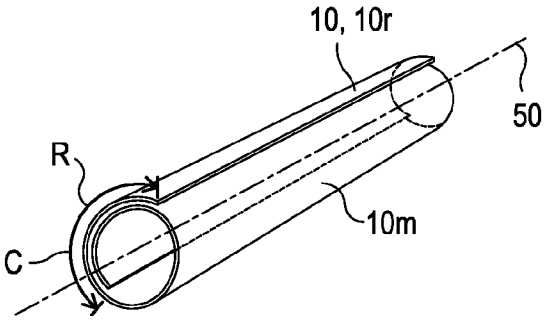
FIG. 2 is a perspective representation of the configuration of the sand screen when rolled up upon the running tool of FIG. 1 with exaggerated separation between layers of the overlapping sections of the screen material.

FIG. 2 shows in further detail how the sand screen device 10 is configured. A sheet of screen material 10*m* is rolled up to form the roll 10*r*. The roll 10*r* can unravel or unroll upon relaxation or release from retainment due to an inherent resilience of the sheet in response to being rolled up. Sections of the screen material are arranged in overlap in the overlapping region R.

The screen material 10*m* has adhesive pre-applied to one or more sections of the screen material. As such, the expandable screen device 10 as shown in FIG. 1 with the adhesive applied to the material of the sheet, can be carried into the wellbore on the running tool 2 to the location in the wellbore for setting the screen. The sheet of screen material 10*m* has apertures (not shown in FIG. 2) which perforate the piece of material. They are sized so that fluid produced from a subterranean formation can pass through and so that solid particles produced from the formation does are hindered from passing through.

The running tool 2 has an inflatable structure 36. The inflatable structure 36 is used to help setting the sand screen device 10 in place in the wellbore.

The inflatable structure 36 comprises a flexible membrane which upon inflation is extendable outwardly. The inflatable structure 36 has end wall portions 36*a*, 36*b* that are fastened sealingly to an outer portion of the tool body 3, in this example by circumferential collar clamps 44*a*, 44*b*. The inflatable structure 36 also has an intermediate, side wall portion 36*i* extending circumferentially around the tool body between the end wall portions 36*a*, 36*b*. The end wall portions 36*a*, 36*b* and side wall portion 36*i* define an inflation chamber 37 around the tool body 3 into which hydraulic fluid enters to inflate the structure 36. The running tool 2 is arranged to direct hydraulic fluid into the inflation chamber 37 through a supply passageway 65. Upon inflation, the wall portions 36*a*, 36*b* adapt and expand radially outwardly from the tool body 3. Through inflation of the inflatable structure 36 an outward force may be imparted to the sand screen device 10, as will be described further in the following.

The screen setting apparatus 1 also includes a heating element 73 which extends around and is arranged between the tool body 3 and the screen 10. More specifically, the heating element 73 is arranged in this example on an outer surface of the tool body 3. The heating element 73 is electrically operated with electrical power delivered through an electrical power line 75 from a power source 104. Heat from the heating element 73 can facilitate activating the adhesive and/or causing the adhesive to adhere and harden, when setting the sand screen device 10 into place in the wellbore.

The sheet of screen material 10*m* is resilient. In the rolled-up configuration of FIGS. 1 and 2, the screen material 10*m* of the sand screen device 10 exerts a component of resilient force urging the sand screen device 10 to expand radially. The bands 12*a*-12*c* retain the roll 10*r* in place against the resilient force. In practice, expansion of the sand screen device 10 involves at least partial unrolling of the roll 10*r*. That is, the region of overlap R between the overlapping sections of the sheet of screen material 10*m* reduces as it unrolls and expands. The sheet of screen material 10*m* in this example is such that the sand screen device 10 expands urged by the resilient force away from the running tool 2 and onto a surrounding wall of the wellbore. At the surrounding wall of the wellbore therefore, the roll 10*r* is expanded and partially unrolled, and the material 10*m* of the sand screen device 10 imparts a radial component of force upon the wall, due to the resilience of the material 10*m* when rolled up. This can help to locate the sand screen device 10 in place upon the wall of the wellbore.

In FIG. 2, the extent of the overlap in the circumferential direction C is indicated as being less than 180 degrees. However, the extent of overlap may vary and may depend upon the hole size at the location it is expanded. Indeed, the sections in other variants overlap so that the expanded roll has several overlapping layers, one within another, that extend the full 360 degrees in the circumferential direction.

The sheet of screen material in this example is in the form of a sheet of steel having a thickness of 0.3 mm. The materials and thicknesses of the material of the sheet can differ in other variants.

In use, the screen setting apparatus 1 is run into the well on a conveyance to position the running tool 2 at a location along the wellbore where the sand screen is required. In this location, the sand screen device 10 is expanded. The bands 12*a*-12*c* are severed and the sand screen device 10 is released and allowed to expand. The sand screen device 10, i.e. the roll 10*r*, expands by itself due to the resilience of the sheet of screen material 10*m*, until it meets the surrounding wall. The heating element 73 is activated to generate heat and increase and control the temperature in the environment of the screen setting apparatus 1 in the wellbore. The inflatable structure 36 is inflated by hydraulic fluid entering the chamber 37. Heat is produced and temperature is obtained causing the bands 12*a*-12*c* to weaken and break. The heat facilitates activation and hardening of the adhesive. The adhesive acts between overlapping sections of the sheet of screen material securing them adhesively together when the roll 10*r* is expanded and positioned at the wall of the wellbore. By inflating the inflatable structure 36 it expands. That is, the intermediate, side wall portion 36*i* of the inflatable structure 36 is urged radially outwardly away from the tool body 3 and exerts a radial component of force outwardly from an inside of the sand screen roll 10*r* against the sand screen device 10 at the wall. The force applied from the inflatable structure 36 helps the adhesive to gain adhesion for securing the overlapping sections of the sheet together. An inner section of the sheet of screen material is adhered to an adjacent overlapping outer section of the sheet. The structure of the sand screen device 10 is locked by the action of the adhesive between the sheet sections. The sand screen device 10 is thus set in place for operational use as a sand screen in production operations. The running tool 2 is then pulled out from the wellbore, leaving the installed sand screen device 10, behind in the well.

Figure 3:
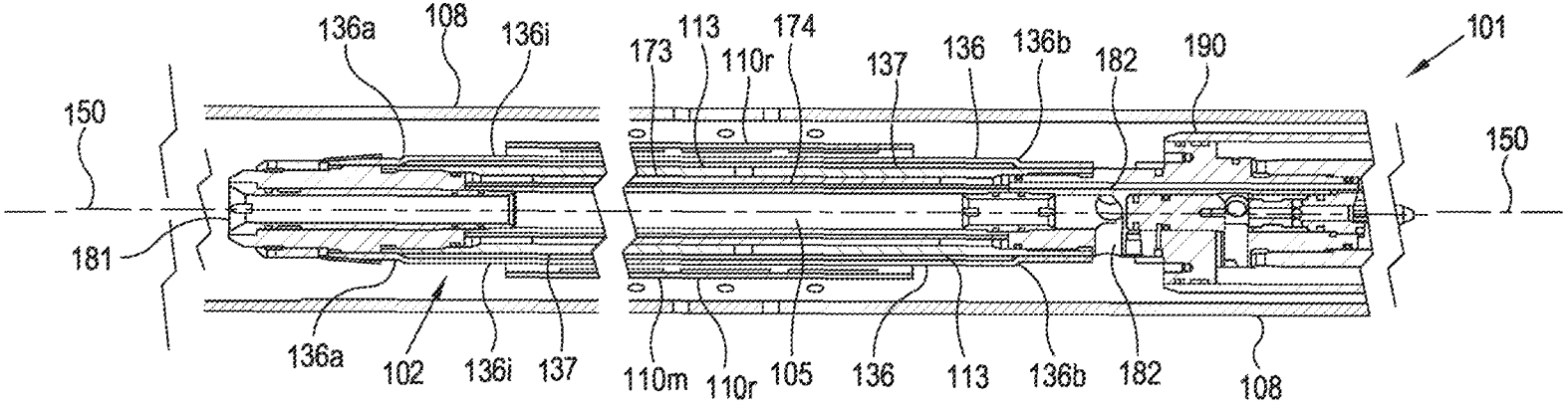
FIG. 3 is a schematic representation of another running tool with a sand screen arranged on the running tool, in use within a perforated casing, in a run-in configuration.

Turning now to FIG. 3, a screen setting apparatus 101 is depicted. The screen setting apparatus 101 is situated in the wellbore within a perforated completion tubing 108 to be provided with a sand screen. Features of the apparatus 101 corresponding to those described in relation to FIGS. 1 and 2 are denoted using the same reference numerals incremented by one hundred.

The tubing 108 has been perforated to allow e.g. a hydrocarbon fluid (not shown) to flow from a reservoir (not shown) into the perforated tubing 108 for production of said hydrocarbon fluid (not shown). The running tool 102 carries an expandable sand screen device 110 in a rolled-up configuration, i.e. in the form of a roll 110*r*. The sand screen device 110 is expandable for providing a tubular sand screen structure on the wall the tubing 108. The expandable sand screen device 110 comprises a piece of screen material 110*m* arranged to extend circumferentially around a main tool body of the running tool 102. The screen device 110 comprises a piece of resilient screen material 110*m* which is rolled up so as to exert a resilient force causing expansion of the roll 110*r* when released. To prevent premature release and unrolling of the material of the roll 110*r*, retainers 112 (omitted from FIG. 3) are used. The apparatus 101 allows setting the sand screen device 110 in the wellbore to prevent or reduce the amount of sand produced with the hydrocarbon fluid from the reservoir.

The screen setting apparatus 101 in this example has a protective sleeve 190 for protecting the expandable screen device 110. The protective sleeve 190 is movable along the tool body. In one position, the protective sleeve 190 is positioned around an outside of the sand screen device 110. The protective sleeve 190 has this position when running the screen setting apparatus 101 into the wellbore. The protective sleeve 190 then provides in effect a barrier structure between the wellbore wall and the sand screen device 110. This can protect against potential contacts with the wellbore wall and prevent damage to the screen device 110 during run-in. It may also hinder potential fouling and contamination of the sand screen device and/or adhesive from fluids or other contents in the wellbore before the running tool 102 has arrived at its destination for setting the screen.

In another position, as depicted in FIG. 3, the protective sleeve 190 is positioned away from the sand screen roll 110*r*. More specifically, the protective sleeve 190 is positioned such that the sand screen roll 110*r* can expand and unroll freely toward the wall of the surrounding tubing 108 without interference from the sleeve 190. The protective sleeve 190 has been pulled back to allow the sand screen roll 110*r* to be released and expand radially.

The running tool 102 is arranged to permit fluid communication along the wellbore through an inside of the main tool body between a location downhole of one end of the roll 110*r* and a location uphole of the other end of the roll 110*r*. This can allow fluid in the wellbore to bypass the sand screen device 110, during the process of applying the sand screen device 110 to the wall of the tubing when the annulus becomes obstructed by the screen and by the expanded inflatable structure. The bypass tube 105 can facilitate to equalise pressure and avoid interference of fluid in the wellbore when the tool 102 is in use for setting the screen device 110.

In FIG. 3, the running tool 102 has a bypass tube 105 which extends longitudinally along the tool body so as to provide a communication passage that bypasses longitudinally the sand screen device 110. The bypass tube 105 is located inside the tool body. The tube 105 is arranged to communicate fluid in the wellbore through the bypass tube 105 between an end port 181 in an end of the tool body downhole of the screen, and side ports 182 extending through a wall of the tool body uphole of the screen. The end port 181 and side ports 102 are in open communication with the wellbore. Thus, when running in and/or during operation to expand the screen roll 110*r*, fluid present in the tubing 108 can obtain communication through the port 181 at a downhole region, through the bypass tube 105, and through the ports 182 at an uphole region.

The running tool 102 also has a heater 173 for heating up the adhesive (not shown) on the screen material of the expandable sand screen device 110. The heater 173 in this example is arranged inside the tool body, more specifically, between an inner surface of the tool body 103 and an outer surface of the bypass tube 105. The heater 173 has elements distributed circumferentially around the tool body. Also, in this example a heat insulation tube 174 is arranged around the bypass tube for insulating the bypass tube from heat generated by the heater 173. Accordingly, the heater 173 is thus arranged in a region between an outer surface of the insulation tube 174 and the inner surface of the main tool body. This may further facilitate to direct and/or utilise generated heat efficiently for the purpose of heating the adhesive on the rolled-up sheet of screen material of the sand screen device 110. The heater 173 has one or more electrically operated elements, such as resistance wires or the like.

The running tool 102 further has an expansion device in the form of a hydraulically inflatable structure 136. The inflatable structure 136 is expandable by hydraulic fluid supplied into the chamber 137 of the bag structure 136. The inflatable structure 136 expands radially so that the sidewalls 136*i* of the inflatable structure 136 can push against an inside of the expanded tubular screen device when located locating the wall.

Although in the examples of FIGS. 1 to 3 the sheet of screen material 10*m*, 110*m* is configured to be resilient when rolled up so as to produce a component of force sufficient for self-unrolling the sheet until it meets the tubing 108, the material can in other variants behave differently. For example, the material of the sheet may not be resilient, or may merely produce a weakly resilient force, or may merely be resilient over part of the required total distance of expansion toward the tubing 108. The inflation device in the running tool 2, 102 is used in such examples to facilitate the unrolling of the screen device. For instance, the inflatable structure 136 imparts a component of force against the inside of the screen roll 110*r* and urges it to expand radially until it meets the wall of the tubing 108 surrounding the running tool 102.

Figure 4:
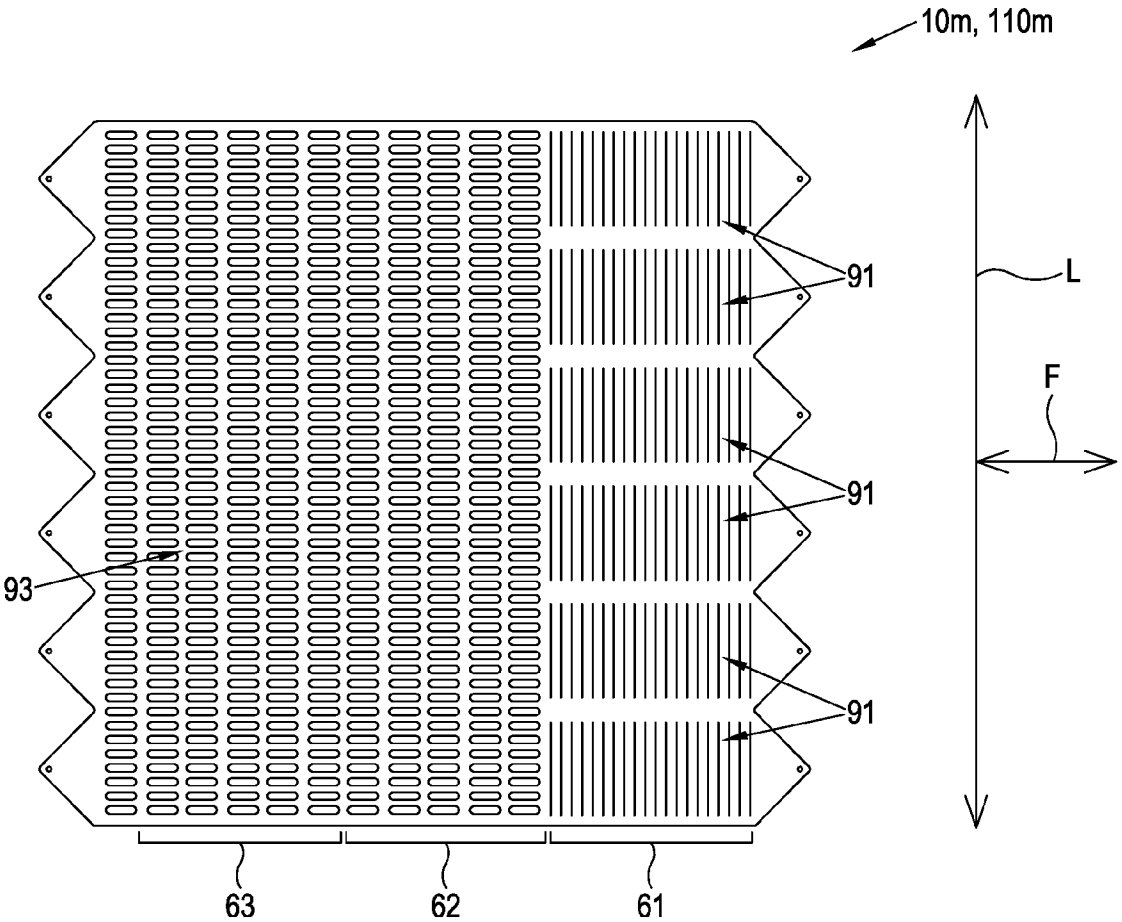
FIG. 4 is a plan view of a sheet of screen material for the sand screen to be arranged on a running tool in FIG. 3.

FIG. 4 depicts a sheet of screen material 10*m*, 110*m* which is rollable up to form the roll 10*r*, 110*r*. The piece of material 10 is in this example a thin spring steel sheet having a thickness of 0.3 mm. Various perforations penetrate through the sheet. The sheet is configured so that upon location on the wall of the tubing 108 the sheet is rolled circumferentially by at least 980 degrees about the roll axis 50. With reference to FIG. 4, the sheet is rollable in the roll direction F. Once rolled, the roll has a longitudinal direction L with a first section 61 of the sheet in overlap wrapping around a second section 62 of the sheet in overlap around a third section 63 of the sheet. The first section 61 when on the wall extends at least 360 degrees about the axis 50 facing the wall of the tubing 108. The first section has sets of parallel "hairline" slits 91 penetrating the sheet. The slits 91 are elongate and extend longitudinally along the long axis L of the roll. The second and third sections 62, 63 have elongate slots 93 that penetrate the sheet. The slots 93 have long axes transverse to the slits. The material in the second and third sections 62, 63 consequently has a different pattern of apertures and material, which facilitates supporting the first section 61 yet provides a sufficient pathway for allowing fluid through the overlapping sections 61, 62, 63 through the material of screen device when expanded and emplaced on the wall of the wellbore.

Adhesive is applied to the piece of material 10 before rolling it up. The adhesive is typically applied only to certain areas. In particular, the adhesive is not required on the surface of the sheet of the first section 61, i.e. where the slits are provided. This is because the first section 61, once rolled up, becomes the outer section of the roll 10*r* inserted in the wellbore, and it is desired to avoid inadvertently blocking the slits by the potential presence of adhesive on this first, outer section 61 of the roll. The adhesive is however typically applied to the surface of the second and third sections 62, 63 which are inner sections overlapped by adjacent overlapping outer sections (e.g. section 61) when rolled up. The adhesive in these sections 62, 63 will allow bonding via the adhesive between the overlapping sections to obtain a tubular sand screen in the wellbore in the form of a locked expanded roll. The adhesive is applied to the second and third sections 62, 63 typically in several transverse bands of adhesive spaced apart longitudinally (in the direction along the long axis L). This may facilitate flow of fluid through the sand screen device once expanded in use in areas of the sheet between adhesive bands.

Figure 5:
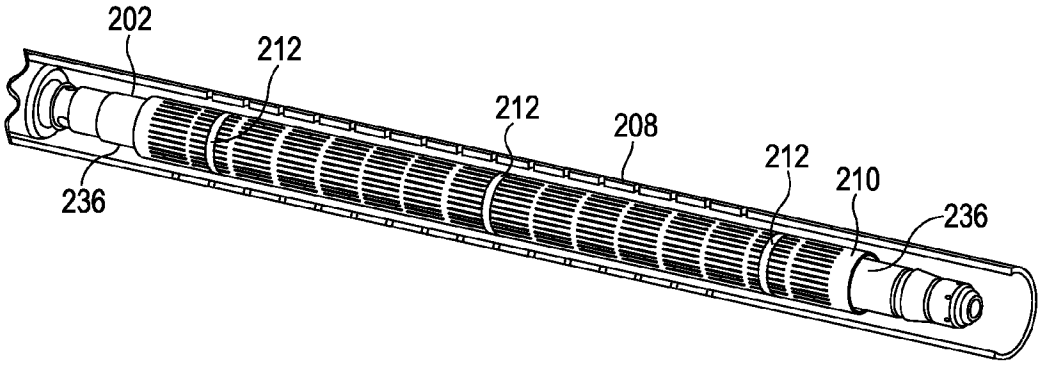
FIG. 5 is a perspective cut-away representation of a running tool with a sand screen arranged on the running tool inside a perforated wellbore casing ready for expanding the screen toward the casing wall.

In FIG. 5, the wellbore has a perforated tubing 208, and the running tool 202 with the expandable sand screen device 210 is ready to be emplaced upon the wall of the perforated tubing 208. Bands 212 retain the sand screen device 210 in rolled-up configuration around the main body of the running tool 202. The hydraulically inflatable structure 236 is not inflated.

Figure 6:
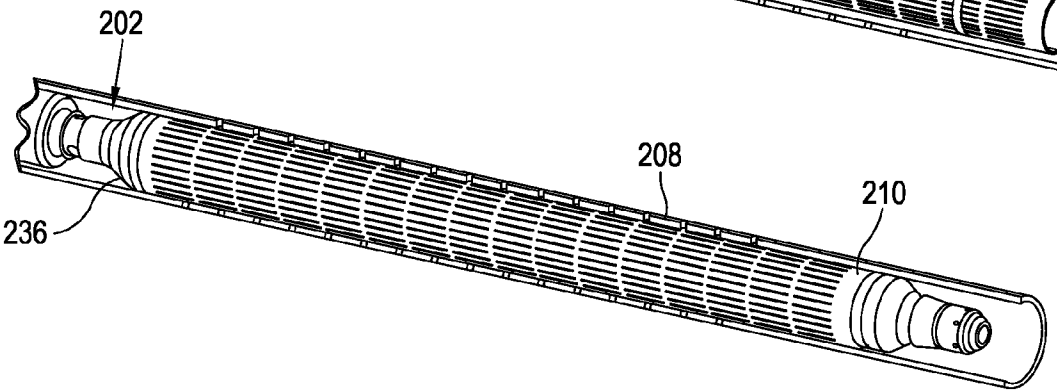
FIG. 6 is a perspective cut-away representation of the running tool with the sand screen of FIG. 5 expanded and bag inflated to press the screen against the casing wall.

In FIG. 6, the sand screen device 210 is released and has expanded against the wall of the perforated tubing 208. The hydraulically inflatable structure 236 is arranged on an inside of the sand screen device. The inflatable structure 236 has been inflated and acts upon the material of the expandable sand screen element 210 to exert a radial component of force upon the material toward the wall of the perforated tubing 208. The inflatable structure 236 acts upon the expandable sand screen device 210 on the wall of the perforated tubing 208 until the adhesive has had time to set and act adheringly between the overlapping sections of the sand screen device 210 to lock the configuration of the sand screen device 210 in the wellbore. The heater (not shown) is used to heat the adhesive while an inner section of the expandable sand screen device 210 to an outer section of the sand screen device 210. The heat provided by the heater can improve one or more properties of the adhesive.

Figure 7:
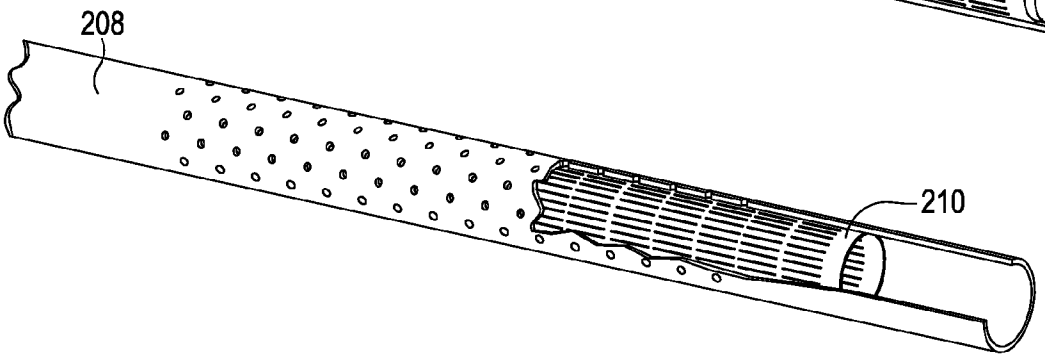
FIG. 7 is a perspective cut-away representation of the sand screen of emplaced on the casing wall and after the running tool FIG. 6 has been removed.

In FIG. 7, the expandable sand screen device 210 is set in place against the wall of the perforated tubing 208. The hydraulically inflatable structure 236 has been deflated and the running tool 202 has been retrieved from the wellbore leaving the screen device 210 in place.

Figure 8:
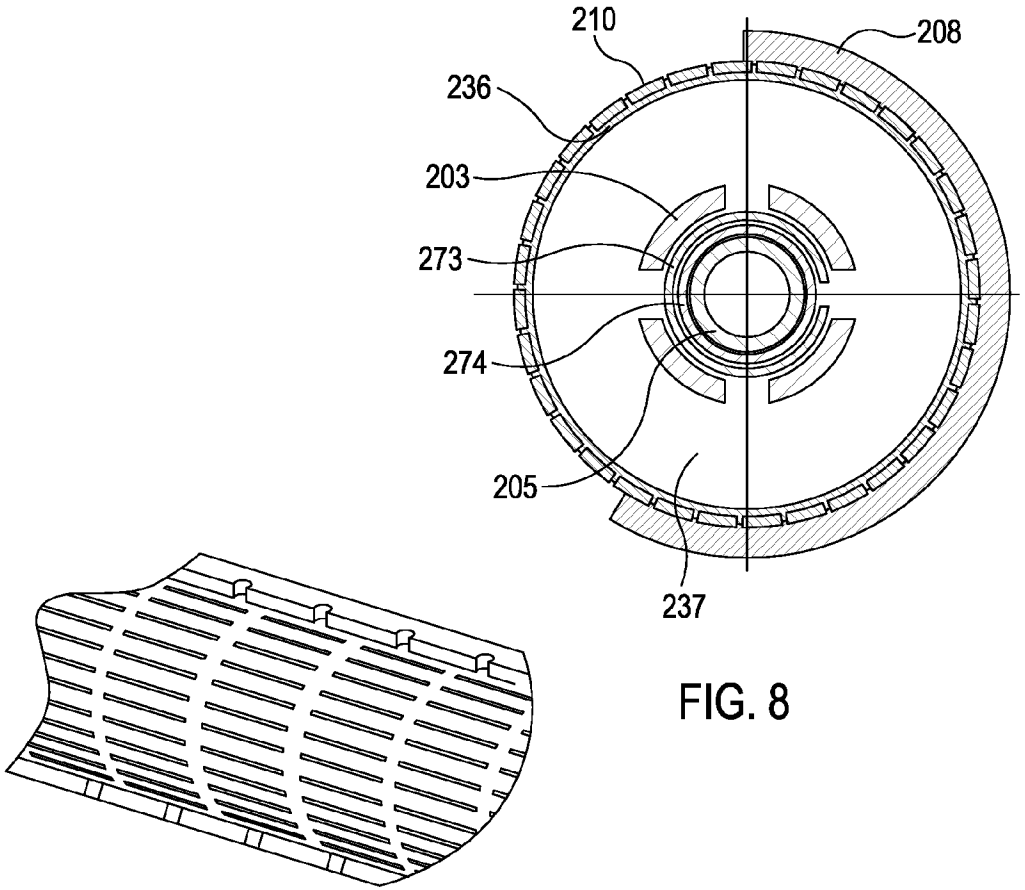
FIG. 8 is a cross sectional representation perpendicular to the longitudinal axis of the casing, the casing, running tool, and sand screen being arranged in the configuration of FIG. 6.

FIG. 8 shows the internal configuration of parts of the expandable sand screen device 210 when expanded against the wall and the bag 236 inflated.

It may be of importance to only apply adhesive to certain parts of the sand screen device, and particularly important to avoid applying adhesive to certain other parts. In particular, the adhesive is desirably applied to avoid the apertures so that they do not get blocked. To this end, it may also be preferable to apply only a thin layer adhesive.

Although in various examples described above the sand screen device is applied to a perforated tubing, in other examples the sand screen device may be set within an existing sand screen, for example to restore screen functionality where the existing screen has previously eroded.

The invention claimed is:

1. An expandable sand screen device comprising a rolled-up piece of screen material which is configured to be at least partially unrollable to expand diametrically when located in a wellbore, wherein the piece of screen material has a thickness in the range of 0.1 to 0.5 mm and is resilient for urging the piece of screen material to at least partially unroll, wherein the piece of screen material comprises a first set of apertures having a longitudinal extent a first direction and a second set of apertures having a longitudinal extent in a second direction which is transverse to the first direction.

2. An expandable sand screen device as claimed in claim 1, wherein the piece of screen material comprises steel or spring steel.

3. An expandable sand screen device as claimed in claim 1, being expandable in diameter between a first configuration in which the piece of screen material is rolled up, and a second, expanded configuration, in which the piece of screen material is at least partially unrolled, wherein the piece of screen material is self-unrollable during expansion from the first to the second configuration.

4. An expandable sand screen device as claimed in claim 1, wherein the piece of screen material has apertures extending through the piece of screen material for restricting passage of sand and permitting passage of fluid from the subsurface penetrated by the wellbore, in operational use.

5. An expandable sand screen device as claimed in claim 1, further comprising adhesive for adhesively securing overlapping sections of the piece of screen material to one another when expanded.

6. An expandable sand screen device as claimed in claim 1, wherein at least in the expanded configuration, sections of the piece of screen material overlap and at least some of the apertures of the first set of apertures cross at least some of the apertures of the second set of apertures to thereby provide screen holes at intersections where apertures of the first and second sets cross, the screen holes penetrating through the overlapping sections of the sand screen device between an outside and an inside of the sand screen device.

7. A sand screen setting assembly comprising:

the expandable sand screen device in accordance with claim 1; and a running tool carrying the expandable sand screen device, wherein the running tool comprises at least one forcing device for applying outward force to the piece of screen material.

8. A sand screen setting assembly as claimed in claim 7, wherein the sand screen device is provided with adhesive for adhesively securing overlapping sections of the piece of screen material to one another when expanded, and wherein the running tool has a heater for supplying heat to the adhesive in use for facilitating activation, curing, or adhesion of the adhesive, and wherein the forcing device is configured to apply outward force to the piece of screen material in an expanded configuration of the sand screen device and in the process of activation, curing or adhesion of the adhesive.

9. A running tool for carrying and deploying an expandable sand screen device in accordance with claim 1 in a wellbore, the running tool comprising:

a tool body;

a structure for supporting the expandable sand screen device on the tool body in the rolled-up configuration in such a way that the piece of screen material extends circumferentially around the main body; and at least one forcing device for imparting outward force to the piece of screen material.

10. A running tool as claimed in claim 9, wherein the forcing device is an inflatable structure.

11. A running tool as claimed in claim 10, wherein the inflatable structure is coupled to fluid communication means and inflatable by supplied hydraulic fluid through the fluid communication means.

12. A running tool as claimed in claim 9, wherein the sand screen device is expandable in diameter between a first configuration in which the screen material is rolled up, and a second, expanded configuration, in which the piece of screen material is at least partially unrolled, wherein the piece of screen material is configured to unroll during expansion from the first to the second configuration, and wherein the forcing device is arranged to facilitate in either or both the first and second configuration to impart outward force to the piece of screen material.

13. A running tool as claimed in claim 9, further comprising a bypass passageway extending along the tool body on an inside of the rolled up or partially unrolled sand screen device, the passageway arranged for communicating wellbore fluid between region downhole of the sand screen device and a region uphole of the sand screen device.

14. A running tool as claimed in claim 9, further comprising at least one heater for supplying heat to facilitate activation, curing, or adhesion of adhesive for adhesively securing the sand screen device to the wellbore wall or adhesively securing overlapping sections of the piece of screen material together.

15. A method of setting a sand screen in a wellbore, the method comprising the steps of:

(a) running a rolled-up expandable sand screen device into the wellbore, the sand screen device comprising a piece of screen material having a thickness in the range of 0.1 to 0.5 mm and wherein the piece of screen material comprises a first set of apertures having a longitudinal extent a first direction and a second set of apertures having a longitudinal extent in a second direction which is transverse to the first direction; and (b) at least partially unrolling the sand screen device in the wellbore, expanding the sand screen device to emplace the sand screen device on a surrounding wall of the wellbore, letting the sand screen device at least partially unroll, the piece of screen material being resilient to urge the sand screen device to unroll; and (c) using at least one forcing device to apply an outward force to the piece of screen material.

16. A method as claimed in claim 15, which includes:

running the rolled-up sand screen device into the wellbore on a running tool, the sand screen device being retained in the rolled-up configuration by at least one retainer;

releasing the sand screen device from retainment, allowing the released sand screen device to at least partially unroll to expand the sand screen device.

17. A method as claimed in claim 16, which includes using the forcing device to apply the outward force to release the sand screen device from retainment.

18. A method as claimed in claim 15, wherein the forcing device has an inflatable structure, and the method includes inflating the inflatable structure to operate the forcing device.

19. A method as claimed in claim 18, which includes inflating the inflatable structure with hydraulic fluid.

20. A method as claimed in claim 15, which in the course of using the forcing device, and in the at least partially unrolled configuration of the sand screen device, includes directing wellbore fluid through a bypass passageway of the running tool on an inside of the sand screen device, between a region of the wellbore downhole of the sand screen device and a region of the wellbore uphole of the sand screen device.

21. A method as claimed in claim 15, wherein the running tool has tool body and a structure for supporting the sand screen device on the tool body in such a way that the sand screen device extends circumferentially around the tool body, the sand screen device is supported on a main body, expanding diametrically away from the tool body.

22. A method as claimed in claim 15, which includes letting the sand screen device self-unroll and expand until it meets the surrounding wall.

23. A method as claimed in claim 15, wherein the method includes using adhesive between adjacent overlapping sections of the piece of screen material to adhesively secure the adjacent overlapping sections together once expanded.

24. A method as claimed in claim 23, which includes producing heat in the wellbore to facilitate use of the adhesive to adhesively secure the sections together.

25. A method as claimed in claim 15, wherein the running tool comprises at least one heater device and, the method includes:

either or both adhesively securing the sand screen device to the wellbore wall, and adhesively securing overlapping sections of the piece of screen material together; and supplying heat from the heater device to facilitate activation, curing, or adhesion of the adhesive.

26. A method as claimed in claim 25, wherein the sand screen device expands in diameter between a first configuration in which the piece of screen material is rolled up, and a second, expanded configuration, in which the piece of screen material is at least partially unrolled, wherein the piece of screen material is resilient to urge the sand screen device to self-unroll during expansion from the first to the second configuration, and which includes:

using the forcing device to impart outward force to the piece of screen material in the second configuration, simultaneously supplying heat from the heater, thereby facilitating the activation, curing, or adhesion of the adhesive.

27. A method as claimed in claim 15, wherein the sand screen device expands in diameter between a first configuration in which the piece of screen material is rolled up, and a second, expanded configuration, in which the piece of screen material is at least partially unrolled, and the sand screen device comprises overlapping sections of the piece of screen material, and wherein the piece of screen material has first slots and second slots which are arranged transverse to the first slots, apertures being formed at the intersection of the transverse first and second slots in the second, expanded configuration, the slots penetrating radially through the sand screen device between an outside and an inside of the device for permitting reservoir fluid flow.

28. A completed well comprising at least one sand screen device which is emplaced on a wall of a wellbore of the well by performing the method of claim 15.

* * * * *